US005489882A

United States Patent [19]

Ueno

[11] Patent Number: 5,489,882

[45] Date of Patent: Feb. 6, 1996

[54] BALANCED-TYPE DIELECTRIC FILTER AND HIGH FREQUENCY CIRCUIT USING BALANCED-TYPE DIELECTRIC FILTER

[75] Inventor: Moriaki Ueno, Soma, Japan

[73] Assignee: Alps Electric Co., Ltd., Tokyo, Japan

[21] Appl. No.: 403,596

[22] Filed: Mar. 14, 1995

[30] Foreign Application Priority Data

Mar. 15, 1994 [JP] Japan ..... 6-044112

[51] Int. Cl.[6] ..... H01P 1/202

[52] U.S. Cl. ..... 333/206; 333/222

[58] Field of Search ..... 333/202, 203, 333/206, 207, 222, 223

[56] References Cited

U.S. PATENT DOCUMENTS 5,124,676 6/1992 Ueno ..... 333/206

5,218,329 6/1993 Vangala et al. ..... 333/206

FOREIGN PATENT DOCUMENTS 164206 6/1994 Japan .

*Primary Examiner*—Benny Lee

*Assistant Examiner*—David Vu

*Attorney, Agent, or Firm*—Guy W. Shoup; Patrick T. Bever

[57] ABSTRACT

A balanced-type dielectric filter for use in a high frequency circuit without requiring a converter. The balanced-type dielectric filter includes a dielectric block having an approximately rectangular parallelepiped shape, at least two inner conductors being disposed in parallel-with a longitudinal direction of the dielectric block and having the length approximately equal to ½ of a selected wavelength. Outer conductors are disposed on at least two outside surfaces of the dielectric block and are parallel to the inner conductors. Two pairs of connecting conductors connect the two inner conductors to input and output terminals located on the side surfaced of the dielectric block, the terminals being insulated from the outer conductors.

6 Claims, 8 Drawing Sheets

BALANCED-TYPE DIELECTRIC FILTER AND HIGH FREQUENCY CIRCUIT USING BALANCED-TYPE DIELECTRIC FILTER

BACKGROUND OF THE INVENTION

1. Field of the Invention

The present invention relates to a balanced-type dielectric filter and a high frequency circuit using the filter, and more particularly, it relates to a balanced-type dielectric filter which can be used in combination with an integrated circuit (IC) or multiple ICs to form a high frequency circuit at a low loss without using a balanced-to-unbalanced converter or an unbalanced-to-balanced converter.

2. Description of the Related Art

Conventional dielectric filters are used in high frequency circuits. These dielectric filters are "unbalanced", and therefore are coupled to ICs within the high frequency circuits using balanced-to-unbalanced converters and unbalanced-to-balanced converters.

FIGS. 5(*a*), 5(*b*) and 6 show an example of a conventional dielectric filter 40, where FIG. 5(*a*) is a perspective view showing internal conductors using hidden lines, FIG. 5(*b*) is a second perspective view with the filter turned upside-down, and FIG. 6 is a cross-sectional view taken along the plane A—A' of FIG. 5(*a*).

As shown in FIG. 5(*a*), FIG. 5(*b*) and FIG. 6, the conventional dielectric filter 40 includes a dielectric block 31 formed around inner conductors 32-1 and 32-2. Each of the inner conductors 32-1 and 32-2 has a length approximately equal to ¼ of a selected wavelength. The inner conductors 32-1 and 32-2 include wide portions 32-1*a* and 32-2*a*, respectively, and also include narrow portions. The filter 40 also includes outer conductors 33-1 to 33-4 formed on top, bottom and side surfaces of the dielectric block 31, and a short-circuiting conductor 34 formed on one end of the dielectric block 31. The filter 40 also includes an input terminal 35-1 and an output terminal 35-2 which are located on the side surfaces of the dielectric block 31 and include terminal electrodes 37-1 and 37-2, respectively. The input terminal 35-1 and output terminal 35-2 are respectively connected to the inner conductors 32-1 and 32-2 by connecting conductors 36-1 and 36-2. Finally, the input terminal 35-1 and output terminal 35-2 are electrically isolated from the outer conductors by insulating portions 38-1 and 38-2, respectively.

The dielectric block 31 is shaped approximately like a rectangular parallelepiped. The inner conductors 32-1 and 32-2, which have approximately square cross-sections, are disposed in parallel within the dielectric block 31 and arranged in a longitudinal direction of the dielectric block 31. The respective ends of the inner conductors 32-1 and 32-2 are exposed through the end surfaces of the dielectric block. The inner conductors 32-1 and 32-2 respectively include a wide portion 32-1*a* and 32-2*a* extending from a midpoint to a first end surface (the hidden end in FIG. 5(*a*)) of the block 31, and a narrow portion extending from the midpoint to the opposite end surface of the block 31 (the exposed end in FIG. 5(*b*)). The wide portions 32-1*a* and 32-2*a* have a lower impedance than the narrower portions.

The outer conductors 33-1 to 33-4 are formed on the top, bottom and side surfaces of the dielectric block (i.e., the surfaces which are parallel to the longitudinal direction of the dielectric block 31). The short-circuiting conductor 34 is formed on one end surface of the dielectric block 31 and short-circuits the inner conductors 32-1 and 32-2 to the outer conductors 33-1 to 33-4.

The input terminal 35-1 and the output terminal 35-2 (which are similarly constructed) are mostly formed the two side surfaces of the dielectric block 31. As shown in FIG. 5(*b*), the input terminal 35-1 and the output terminal 35-2 respectively include connecting conductors 36-1 and 36-2, terminal electrodes 37-1 and 37-2, and insulating portions 38-1 and 38-2 formed between the outer conductors 33-1, 33-3 and 33-4, and the terminal electrodes 37-1 and 37-2. The connecting conductors 36-1 and 36-2 respectively extend from the wider portions 32-1*a* and 32-1*b* of the inner conductors 32-1 and 32-2 to the terminal electrodes 37-1 and 37-2 through the dielectric block 31 to electrically connect the terminal electrodes 37-1 and 37-2 to the wider portions 32-1*a* and 32-2*a* of the inner conductors.

The conventional dielectric filter 40, as described above, is a distributed constant line filter composed of the inner conductors 32-1 and 32-2 and the outer conductors 33-1 to 33-4, and it constitutes a resonant circuit of a type having one end open-circuited and the other end short-circuited. That is, the exposed ends of the narrow portions of the inner conductors 32-1 and 32-2 are insulated from the outer conductors 33-1 to 33-4 while the wide portions 32-1*a* and 32-2*a* of the inner conductors 32-1 and 32-2 are short-circuited to the outer conductors 33-1 to 33-4 by the short circuiting conductor 34.

In the prior art filter 40, the dielectric block 31 is first formed, and then the inner conductors 32-1 and 32-2, the outer conductors 33-1 to 33-4, the short circuiting conductor 34, the connecting conductors 36-1 and 36-2 and the terminal electrodes 37-1 and 37-2 are formed on the dielectric block 31. For example, after the dielectric block is produced, a conductive paste is applied in necessary patterns on the surfaces of the dielectric block 31 and then the patterns are baked. Alternatively, the patterns are formed by electrodeless copper plating.

In such a conventional dielectric filter 40, the dominant coupling between the inner conductors 32-1 and 32-2 is by a magnetic field generated in the proximity of the exposed end of the wide portions 32-1*a* and 32-2*a*, which are connected by the short circuiting conductor 34. On the other hand, in the proximity of the exposed ends of the narrow portions of the inner conductors 32-1 and 32-2 (that is, at the end which is opposite the short circuiting conductor 34), the dominant coupling between the inner conductors 32-1 and 32-2 is provided by an electric field. Currents are produced in the inner conductors 32-1 and 32-2 which are induced both by the magnetic coupling and the electric coupling, and these currents are opposite in phase; therefore, these currents are completely or partly canceled by each other. In the conventional dielectric filter 40, the wide portions 32-1*a* and 32-2*a* of the inner conductors 32-1 and 32-2 are formed at the end of the filter 40 which is connected by the short circuiting conductor 34. Therefore, the magnetic coupling between the wide portions 32-1*a* and 32-2*a* dominates over the electrical coupling between the narrow portions of the inner conductors.

FIG. 7 is a block circuit diagram showing an example of a conventional high frequency circuit in which the dielectric filter 40 is used in combination with ICs 41 and 42.

As shown in FIG. 7, the dielectric filter 40 is connected to the IC 41, which forms a preceding stage, and to the 42, which forms a following stage. The dielectric filter 40 is connected through a balanced-to-unbalanced converter 43-1 to the IC 41, and through an unbalanced-to-balanced converter 43-2 to the IC 42. The IC 41 includes differential-connection transistors 44-1 and 44-2 and constant current transistors 45-1 and 45-2. Load resistances 46-1 and 46-2 are connected to the differential-connection transistors 44-1 and 44-2. The IC 41 is connected to the balanced-to-unbalanced converter 43-1 through coupling capacitors (DC blocking capacitors) 47-1 and 47-2. Similarly, the IC 42 is connected to the unbalanced-to-balanced converter 43-2 through coupling capacitors (DC blocking capacitors) 48-1 and 48-2. The IC 42 includes differential-connection transistors 49-1 and 49-2 and constant current transistors 50-1 and 50-2, and load resistances 51-1 and 51-2.

The IC 41 and the IC 42 are of a balanced-output and balanced-input type, respectively, and a large number of such ICs are used in high frequency circuits. The dielectric filter 40 is of an unbalanced-type, as shown in FIGS. 5(*a*), 5(*b*) and 6. Because the dielectric filter 40 is unbalanced, the balanced-to-unbalanced converter 43-1 is required on the input side of the dielectric filter 40, and the unbalanced-to-balanced converter 43-2 is required on the output side of the dielectric filter 40. The IC 41 includes a differential output stage including differential-connection transistors 44-1 and 44-2, transistors 45-1 and 45-2 for generating a constant current source, and load resistances 46-1 and 46-2. On the other hand, the IC 42 includes a differential input stage composed of differential-connection transistors 49-1 and 49-2, transistors 50-1 and 50-2 for generating a constant current source, and load resistances 51-1 and 51-2. In this case, when the filtered frequency band is comparatively low, it is possible to employ a wound-type converter as the balanced-to-unbalanced converter 43-1 and the unbalanced-to-balanced converter 43-2, but in general, a distributed constant line, such as a microstrip line, is used for the balanced-to-unbalanced converter 43-1 and the unbalanced-to-balanced converter 43-2.

In the conventional dielectric filter described above, a high frequency balanced signal output from the IC 41 is converted to a high frequency unbalanced signal by the balanced-to-unbalanced converter 43-1, and then the signal is input to the dielectric filter 40 to eliminate unnecessary frequency components. The high frequency unbalanced signal output from the dielectric filter 40 is then converted back to a high frequency balanced signal by the unbalanced-to-balanced converter 43-2, and it is then supplied to the IC 42.

In the conventional high frequency circuit, when a dielectric filter 40 is used in combination with ICs having a balanced output and a balanced input, it is necessary to use the balanced-to-unbalanced converter 43-1 and the unbalanced-to-balanced converter 43-2. These converters degrade the function of the high frequency circuit incorporating the dielectric filter 40 due to the insertion loss of the balanced-to-unbalanced converter 43-1 and the unbalanced-to-balanced converter 43-2. Further, a significant amount of space is needed for the converters 43-1 and 43-2, and the manufacturing cost of the high frequency circuit is significantly increased by the cost of these converters.

SUMMARY OF THE INVENTION

An object of the present invention is to eliminate the insertion loss caused by the balanced-to-unbalanced converter and the unbalanced-to-balanced converter, and also to provide a balanced-type dielectric filter which enables a small-sized and low-cost high frequency circuit.

In order to achieve the above-mentioned object, the present invention comprises a filter including a dielectric block having an approximately rectangular parallelepiped shape; at least two inner conductors, each having a length approximately equal to ½ of a selected wavelength, disposed in parallel in a longitudinal direction of the dielectric block and extending through the inside of the block to opposite ends of the block; outer conductors disposed on the at least two outside surfaces of the dielectric block which are parallel to the inner conductors; two pairs of connecting conductors respectively connected to the inner conductors and extending to respective side surfaces of the dielectric block; and two pairs of input and output terminals, each of the input and output terminals including a terminal electrode formed on the sides of the block and electrically insulated from the outer conductors formed on the block, and connected to one of the connecting conductors.

According to the present invention, at least two pieces of inner conductors, each having the length of approximately equal to ½ of a selected wavelength, penetrate through the inside of a dielectric block and are disposed parallel to the longitudinal direction of the block. In addition, two pairs of connecting conductors, each pair of connecting conductors connected to one of the two inner conductors, extend between the inner conductors and the exterior side surfaces of the dielectric block, and two pairs of input and output terminals are connected to the connecting conductors to form a balanced-type dielectric filter. Because the filter is a balanced-type filter, a high frequency input signal can be directly received from an input stage IC without using a balanced-to-unbalanced converter, and a filtered high frequency signal can be transmitted directly from the dielectric filter to an output stage IC without using an unbalanced-to-balanced converter. Therefore, there is no need for a balanced-to-unbalanced converter or an unbalanced-to balanced converter at the input and output terminals of the dielectric filter respectively, which have been required in applications using the conventional dielectric filter. This eliminates the insertion loss caused by the balanced-to-unbalanced converter and the unbalanced-to-balanced converter, saves the space required for accommodating the converters, and also reduces the manufacturing cost by the cost of the converters.

DESCRIPTION OF THE PREFERRED EMBODIMENTS

Figure 1A:
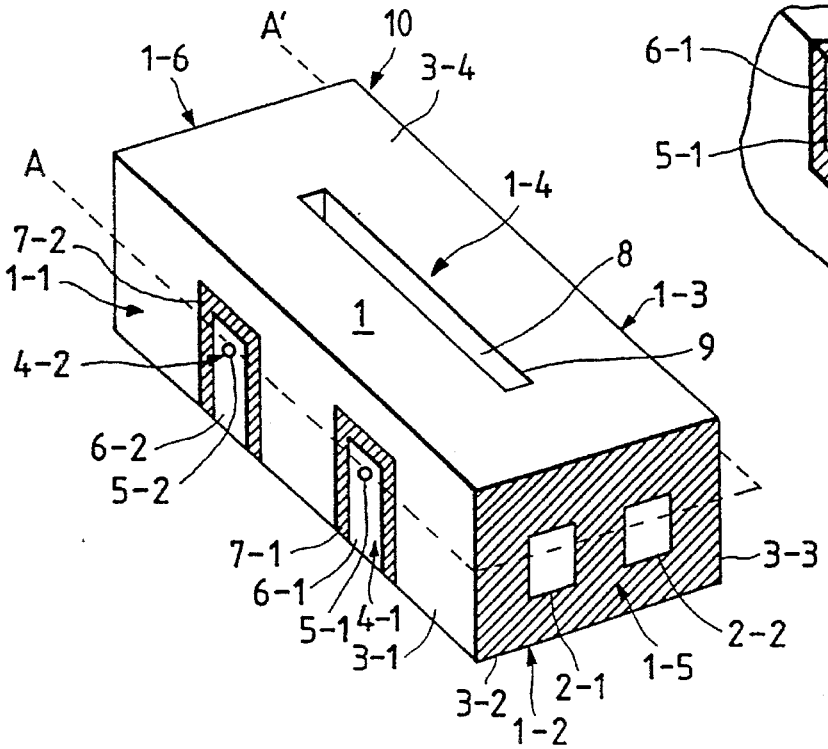
FIGS. 1(*a*), 1(*b*) and 1(*c*) are perspective, section and partial perspective views showing a balanced-type dielectric filter according to a first embodiment of the present invention.

The embodiments according to the present invention will be explained in detail referring to the drawings.

Figure 1C:
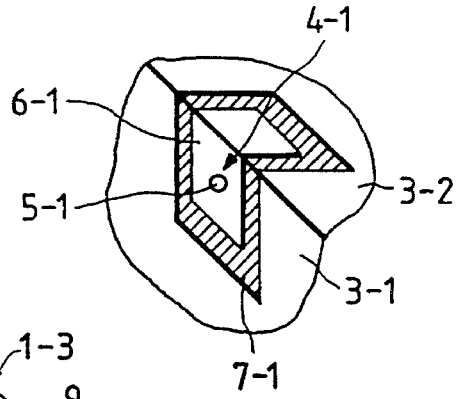
Figure 1B:
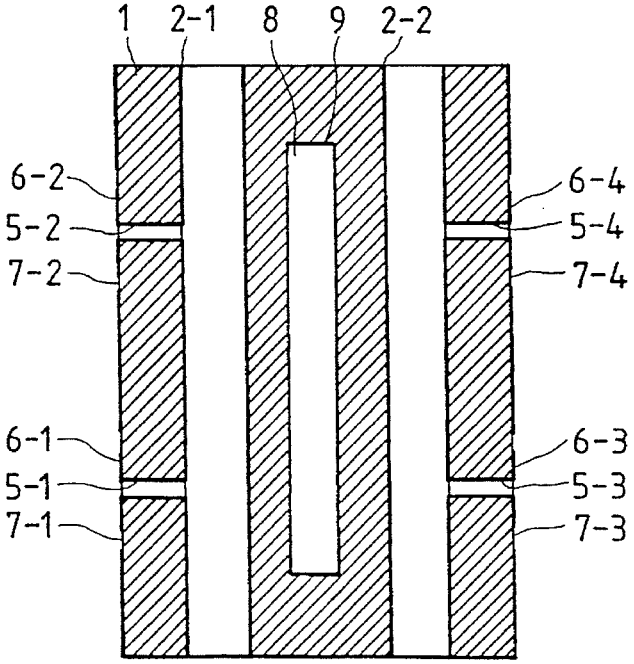

FIGS. 1(*a*), 1(*b*) and 1(*c*) show a balanced-type dielectric filter 10 according to the first embodiment of the present invention, where FIG. 1(*a*) is a perspective view of the filter, FIG. 1(*b*) is a cross-sectional view taken along the plane A—A' shown in FIG. 1(*a*), and FIG. 1(*c*) is a partial perspective view showing a terminal of the filter shown in FIG. 1(*a*).

The dielectric filter 10 includes a dielectric block 1 which includes outside surfaces 1-1 to 1-6, inner conductors 2-1 and 2-2 having length approximately equal to ½ of a selected wavelength, outer conductors 3-1 to 3-4, input terminals 4-1 and 4-2, output terminals 4-3 and 4-4, connecting conductors 5-1 to 5-4, terminal electrodes 6-1 to 6-4, insulating portions 7-1 to 7-4, a through-hole 8, and a shielding conductor 9.

The dielectric block 1 has an approximately rectangular parallelepiped shape which, for the purposes of explanation, includes exterior side surfaces 1-1 and 1-3 (demarcated by the length and the height of the dielectric block 1), exterior lower and upper surfaces 1-2 and 1-4 (demarcated by the length and the width of the dielectric block 1), and exterior end surfaces 1-5 and 1-6 (demarcated by the width and the height of the dielectric block 1). The inner conductors 2-1 and 2-2 have square cross sections, and are disposed in parallel with a longitudinal direction of the dielectric block 1 extending through the inside of the block 1 from exterior end surface 1-5 to exterior end surface 1-6. The upper, lower and side outer conductors 3-1 to 3-4 are respectively disposed on the exterior top, bottom and side surfaces 1-1 to 1-4, but the exterior side surfaces 1-5 and 1-6 of the dielectric block 1 remain exposed. Input terminals 4-1 and 4-2 include a first portion formed on the exterior side surface 1-1, and include a second (smaller) portion extending onto lower exterior surface 1-2. Similarly, output terminals (not shown) include a first portion formed on the exterior side surface 1-3, and include a second (smaller) portion extending onto lower exterior surface 1-2. The input electrode 4-1 includes, as shown in FIG. 1(*c*), a terminal electrode 6-1 electrically connected to the connecting conductor 5-1, and is separated from the side and lower outer conductors 3-1 and 3-2 by the insulating portion 7-1. The input terminal 4-2 and the output terminals 4-3 and 4-4 have the same construction as that of the input terminal 4-1. The connecting conductors 5-1 and 5-2 extend through the dielectric block 1 from the inner conductor 2-1 to the terminal electrodes 6-1 and 6-2 to electrically connect the terminal electrodes 6-1 and 6-2 to the inner conductor 2-1. Similarly, the connecting conductors 5-3 and 5-4 extend through the dielectric block 1 from the inner conductor 2-2 to the terminal electrodes 6-3 and 6-4 and electrically connect the terminal electrodes 6-3 and 6-4 to the inner conductor 2-2. The through hole (slot) 8 is provided in the dielectric block 1 between the inner conductors 2-1 and 2-2, and has a cross section of a thin, long rectangle which extends parallel to the inner conductors 2-1 and 2-2. The shielding conductor 9 is formed on the inside surface of the through hole 8, and end portions of the shielding conductor 9 are electrically connected to the upper and lower conductors 3-2 and 3-4.

Connecting conductors 5-1 and 5-2 are respectively disposed at equal distances from the end surfaces 1-5 and 1-6 of the dielectric block 1. Similarly, connecting conductors 5-3 and 5-4 are respectively disposed at equal distances from the end surfaces 1-5 and 1-6 of the dielectric block 1. The shielding conductor 9 (located in the through hole 8) is centered between the inner conductors 2-1 and 2-2 and at equal distances from the end surfaces 1-5 and 1-6 of the dielectric block 1. Similar to the conventional dielectric filter 40, in the present embodiment, respective electrodes and conductors are formed, for example, by applying a conductive paste to the dielectric block 1 then baking the dielectric block 1 so that the conductors are formed, or by forming the conductors by electrodeless copper plating.

A balanced-type dielectric filter in the first embodiment having the constitution as described above is a filter of a distributed constant-line type being composed of inner conductors 2-1 and 2-2 and outer conductors 3-1 to 3-4 (which surround the inner conductors), with both end parts of the inner conductors 2-1 and 2-2 being insulated from the outer conductors 3-1 and 3-2. Therefore, the inner and outer conductors form an ½ wavelength resonance circuit with both ends opened. In general, in the case of an ½ wavelength resonant circuit, in the central part in the longitudinal direction of respective inner conductors 2-1 and 2-2, a node is formed where the voltage is zero and the current is maximum, and from that node toward both side surfaces 1-5 and 1-6, the voltage becomes higher and the current becomes smaller. Furthermore, the polarity of the voltage is reversed at the node. In the case of the balanced-type dielectric filter 10 in the first embodiment, in the area between the inner conductors 2-1 and 2-2, which is the area where magnetic coupling should be dominant, the shielding electrode 9 is provided which shields the inner conductors 2-1 and 2-2 from each other. Therefore, when the ½ wavelength resonant circuit is observed as a whole, magnetic coupling between the inner conductors is weak, and the dielectric filter can be regarded as the one in which the coupling by an electric field is dominant.

Figure 5A:
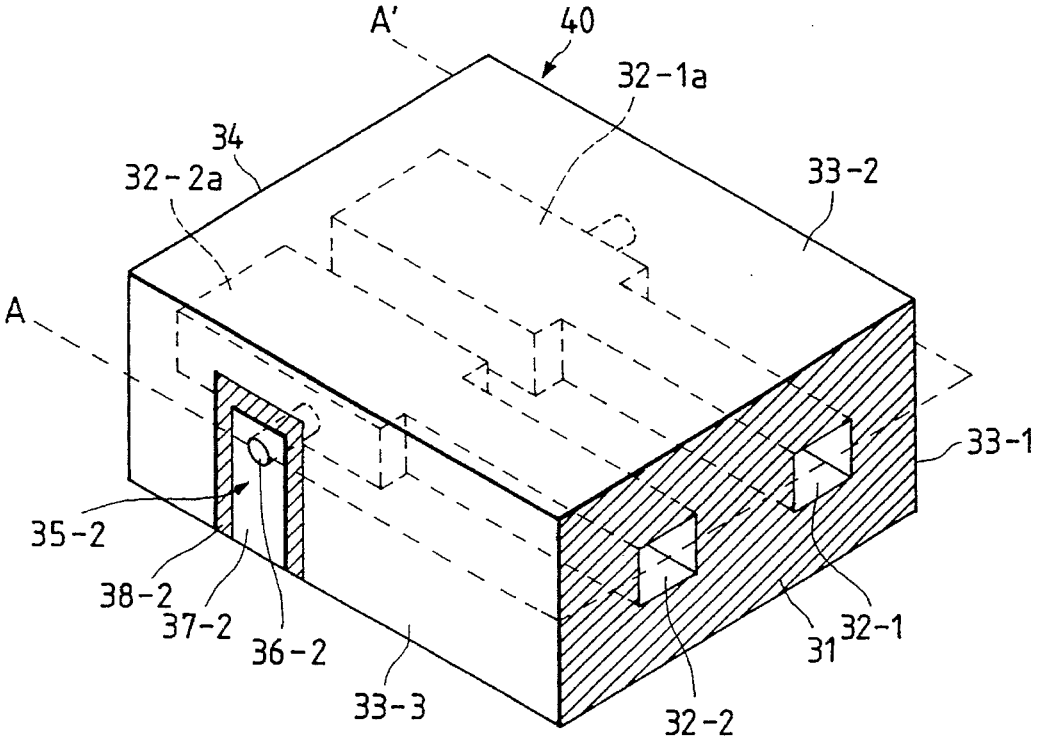
FIG. 5(a) PRIOR ART
FIGS. 5(*a*) and 5(*b*) are perspective views showing an example of a conventional unbalanced-type dielectric filter.
Figure 5B:
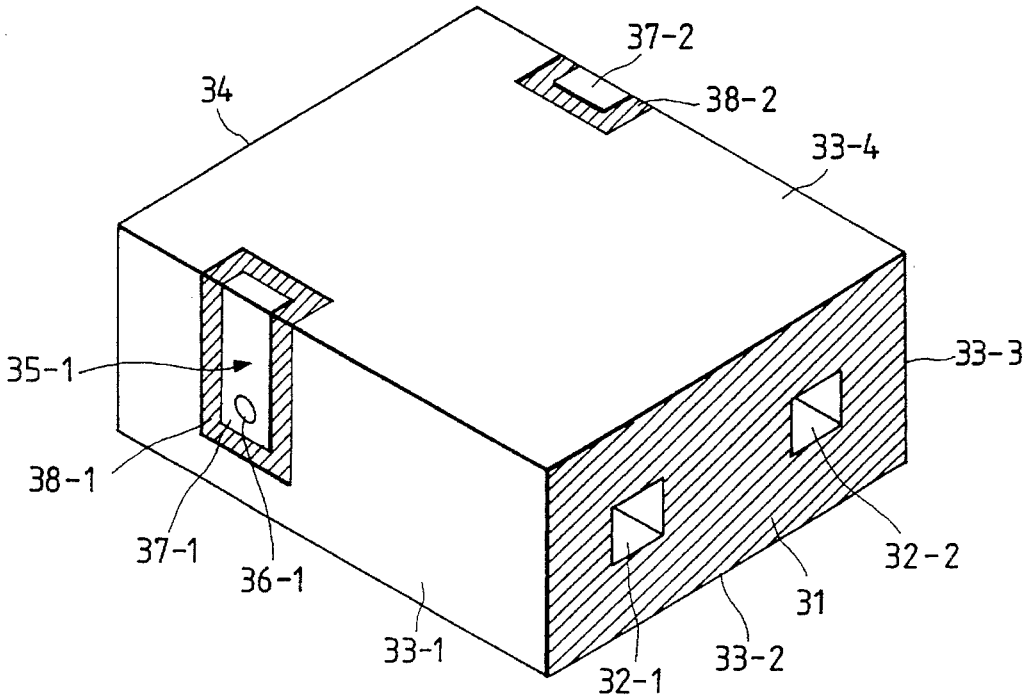
FIG. 5(b) PRIOR ART
Figure 6:
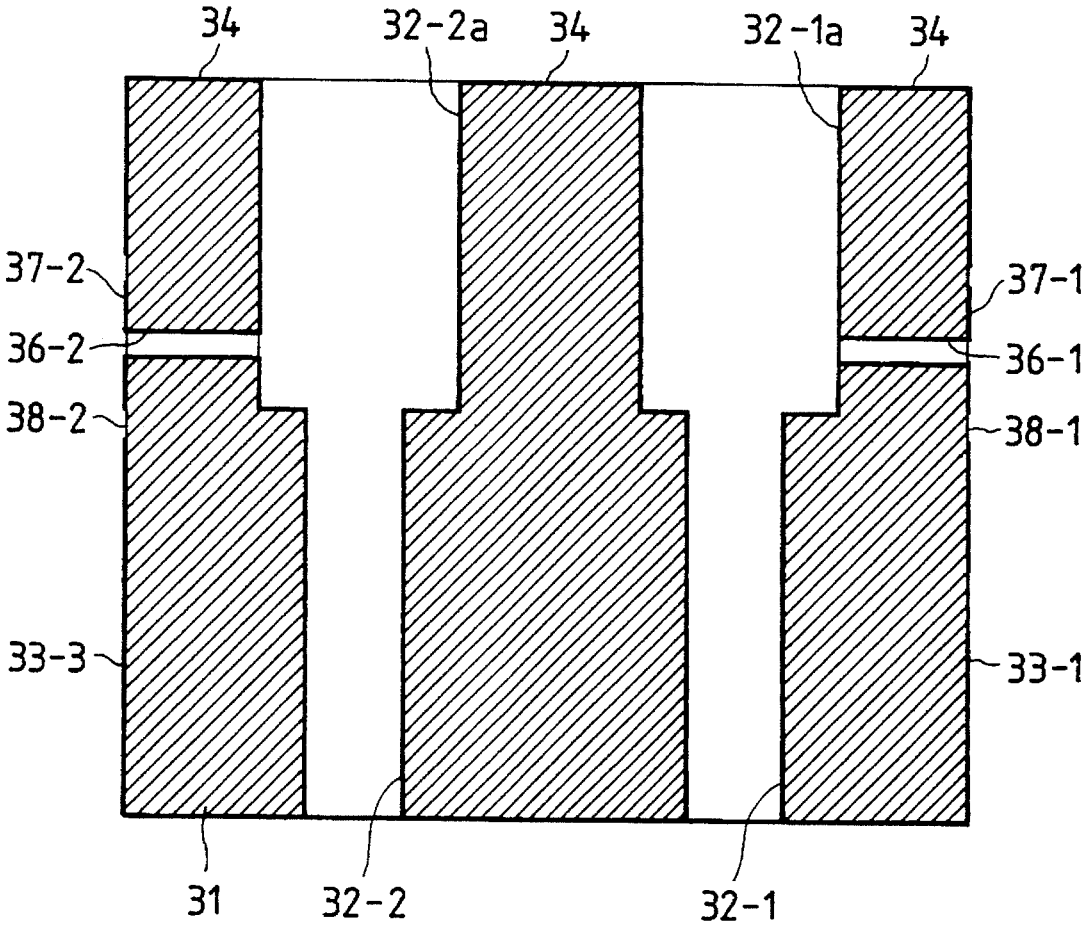
FIG. 6 PRIOR ART
FIG. 6 is a cross-sectional view showing the conventional unbalanced-type dielectric filter shown in FIGS. 5(*a*) and 5(*b*).
Figure 7:
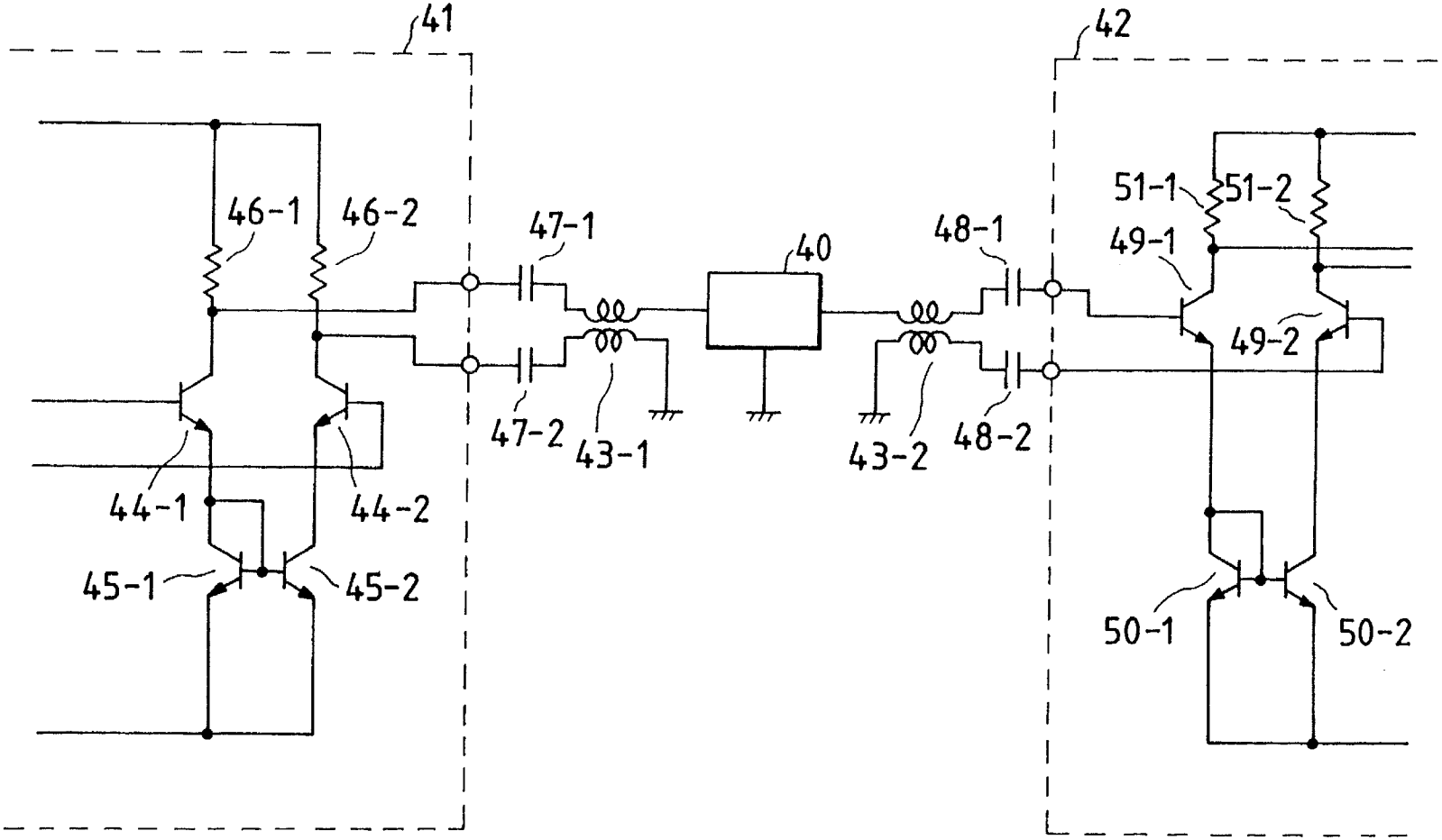
FIG. 7 PRIOR ART
FIG. 7 is a block circuit diagram showing an example of a high frequency circuit in which the conventional unbalanced-type dielectric filter shown in FIGS. 5(*a*), 5(*b*) and 6 is used in combination with ICs.

In this case, in the basic operation, the balanced-type dielectric filter 10, as shown in the first embodiment, can be regarded as a filter which is formed by two pieces of conventional unbalanced dielectric filters 40, as shown in FIG. 5(*a*), FIG. 5(*b*) and FIG. 6, joined together along the respective planes having the short-circuiting conductors 34, and the position of the node falls on the joining plane, that is, the position of the short-circuiting conductors 34, and the node can be considered as a virtual grounding point.

Substantial differences exist between the balanced-type dielectric filter 10 according to the first embodiment (hereinafter referred to as a balanced filter) and a dielectric filter formed by joining two conventional unbalanced-type dielectric filters in a back-to-back manner (hereinafter referred to as a joined filter).

First, the node in the balanced filter is a virtual grounding point; in contrast with this, the short-circuiting conductors 34 of a joined filter is an actual grounding point. The operations of both filters differ much from each other because of this difference.

The balanced filter is a balanced-type dielectric filter having balanced input terminals 4-1 and 4-2, and balanced output terminals 4-3 and 4-4, and both connecting conductors 5-1 and 5-2 are electrically connected to the inner conductor 2-1, and a current loop is formed between connecting conductors 5-1 and 5-2. Therefore, when a current flows into either of the connecting conductors 5-1 and 5-2, the same quantity of current flows out from the other. The connecting conductors 5-3 and 5-4, are electrically connected the inner conductor 2-2, and a current loop is formed between connecting conductors 5-3 and 5-4; therefore, when a current flows into either of the connecting conductors 5-3 and 5-4, the same quantity of current flows out from the other one. The node, a virtual grounding point, is located between the two connecting conductors 5-1 and 5-2, and also located between the two connecting conductors 5-3 and 5-4. In this case, if the midpoints of the inner conductors 2-1 and 2-2 coincide with the midpoints of the two connecting conductors 5-1 and 5-2 and those of the two connecting conductors 5-3 and 5-4, the node is positioned at the physical midpoint of the two connecting conductors 5-1 and 5-2, and also at the physical midpoint of the two connecting conductors 5-3 and 5-4. However, it is difficult to obtain two complete symmetrical circuits because of imperfections in the manufacturing process of balanced-type dielectric filters, so that the actual node is located at a position which deviates slightly from the physical midpoints of the two connecting conductors 5-1 and 5-2 and also from those of the two connecting conductors 5-3 and 5-4.

Even if the position of the node deviates from the physical midpoints, since current loops are formed between the connecting conductors 5-1 and 5-2, and between connecting conductors 5-3 and 5-4, when a current flows into either of the connecting conductors 5-1 and 5-2, or 5-3 and 5-4, a current of the same quantity flows out from the other connecting conductors, 5-1 and 5-2, or 5-3 and 5-4.

In the case of a joined filter, the position of the node is located at the joining point, that is, at the position of the short-circuiting conductor 34. When imperfections occur in the manufacturing process between the two dielectric filters to be joined, the impedance seen from the connecting conductor 36-1 to the side of inner conductor 32-1 in one dielectric filter differs from that in the other dielectric filter. In the same way, the impedance seen from the connecting conductor 36-2 to the side of inner conductor 32-2 in one dielectric filter differs from that in the other dielectric filter. Concerning the currents which flow in respective pieces of dielectric filters of a joined filter, there is no transfer of current between the connecting conductors 36-1 or between the connecting conductors 36-2 in two pieces of dielectric filters, and the transfer of a current is performed among the connecting conductors 36-1 and 36-2, and one of the outer conductors 33 in respective pieces of dielectric filters. When the impedance seen from the connecting conductor 36-1 to the side of the inner conductor 32-1 in a piece of dielectric filter differs from that in another piece of dielectric filter, and also the impedance seen from the connecting conductor 36-2 to the side of the inner conductor 32-2 in a piece of dielectric filter differs from that in another piece of dielectric filter, the magnitudes of the currents which flow in respective pieces of dielectric filters are different, and it becomes impossible to obtain balanced input characteristics and balanced output characteristics. In the case of a joined filter, in order to obtain balanced input/output characteristics, it is necessary to choose two pieces of dielectric filters which are completely identical in dielectric constant and dimension; however, as described in the above it is impossible to obtain a pair of dielectric filters which are completely identical because of the imperfections generated in the manufacturing process. Therefore, it is difficult to obtain a joined filter having desired balanced input/output characteristics.

As described above, the constitution and the function of a balanced filter according to the first embodiment of the present invention are superior to those of a joined filter, that is, a filter composed of two conventional dielectric filters joined together in a back-to-back manner.

Figure 2:
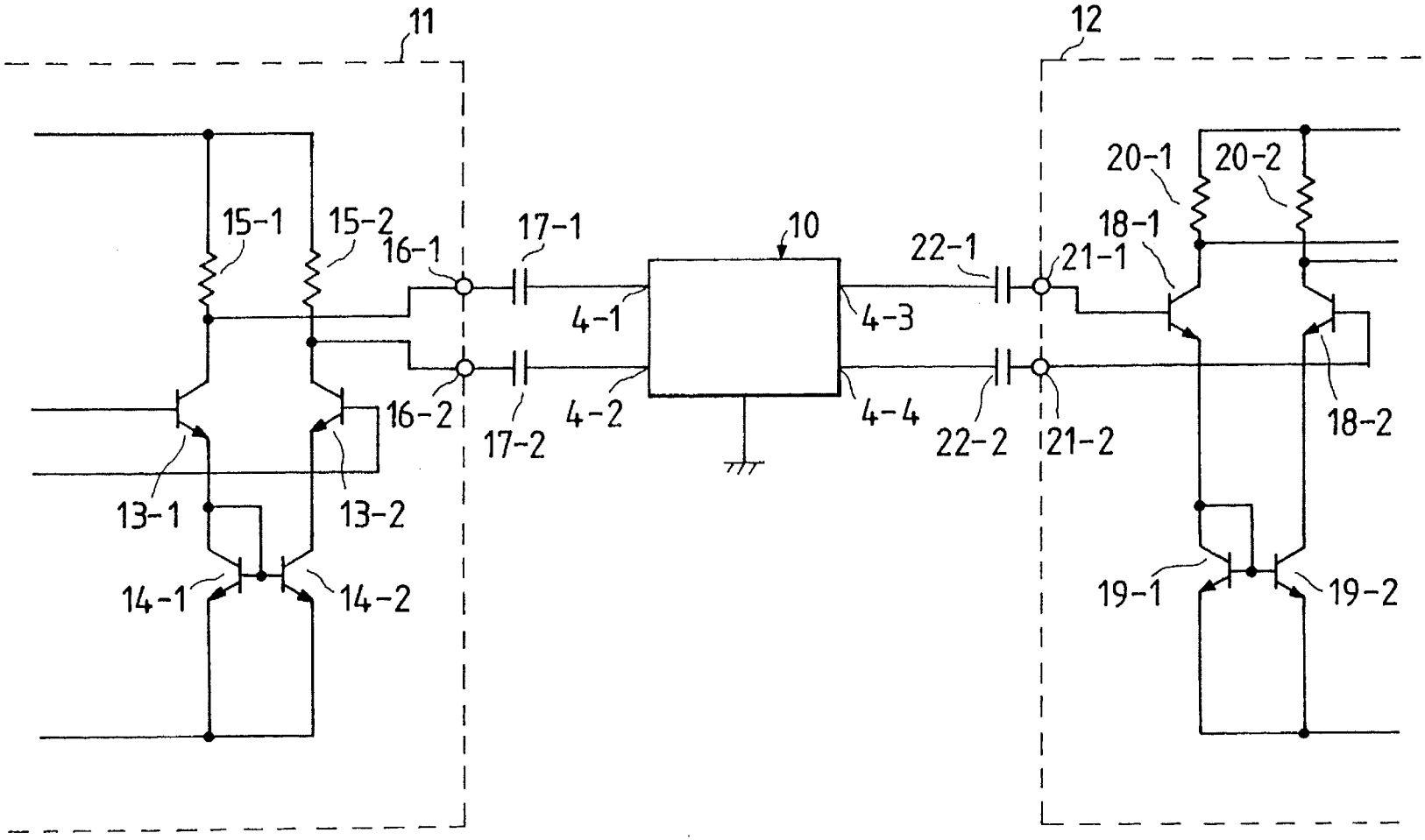
FIG. 2 is a block circuit diagram showing an example of a high frequency circuit in which a balanced-type dielectric filter in the first embodiment shown in FIG. 1 is used in combination with ICs.

FIG. 2 is a block circuit diagram showing an example of a high frequency circuit in which a balanced-type dielectric filter 10 in the first embodiment shown in FIG. 1 is used in combination with ICs.

In FIG. 2, the high frequency circuit includes a balanced-type dielectric filter 10 connected between an IC 11 (forming a preceding stage) and an IC 12 (forming a following stage). The IC 11 includes differential-connection transistors 13-1 and 13-2 connected to transistors 14-1 and 14-2, which are used as a constant current source, and to load resistors 15-1 and 15-2. Output terminals 16-1 and 16-2 of the IC 11 are connected through coupling capacitors (DC blocking capacitors) 17-1 and 17-2 to the input terminals 4-1 and 4-2 of the filter 10. Output terminals 4-3 and 4-4 are respectively connected through coupling capacitors (DC blocking capacitors) 22-1 and 22-2 to input terminals 21-1 and 21-2 of the IC 12. The IC 12 includes differential-connection transistors 18-1 and 18-2, which are connected to transistors 19-1 and 19-2, which provide a constant current source for the IC 12, and to load resistors for transistors 20-1 and 20-2. The input and output terminals 4-1 to 4-4 are the same as those discussed with respect to FIG. 1(*a*), 1(*b*) and 1(*c*).

ICs of a balanced input/output type are used for the IC 11 and the IC 12, and a large number of them are used in high frequency circuits of this kind. The output terminals 16-1 and 16-2 of the IC 11 are connected respectively to the input terminals 4-1 and 4-2 of the balanced-type dielectric filter 10 through respective coupling capacitors 16-1 and 16-2, and the output terminals 4-3 and 4-4 of the balanced-type dielectric filter 10 are connected respectively to the input terminals 21-1 and 21-2 of the IC 12 through respective coupling capacitors 22-1 and 22-2. The IC 11 comprises a differential output stage being composed of differential-connection transistors 13-1 and 13-2, constant current transistors 14-1 and 14-2, and load resistors 15-1 and 15-2. The IC 12 comprises a differential input stage composed of differential-connection transistors 18-1 and 18-2, constant current transistors 19-1 and 19-2, and load resistors 20-1 and 20-2.

A high frequency balanced-type output signal transmitted from the output terminals 16-1 and 16-2 of the IC 11 is input to the input terminals 4-1 and 4-2 of the balanced-type dielectric filter 10 through coupling capacitors 17-1 and 17-2 to eliminate unnecessary frequency components. A filtered high frequency balanced-type signal is output from the balanced-type dielectric filter 10 and input to the input terminals 21-1 and 21-2 of the IC 12 through the coupling capacitors 20-1 and 20-2.

As described in the above, it is possible to transfer a balanced-type signal from the IC 11 to the IC 12 without using a balanced-to-unbalanced converter or an unbalanced-to-balanced converter on the input and output sides of a balanced-type dielectric filter 10 according to the first embodiment.

Figure 3A:
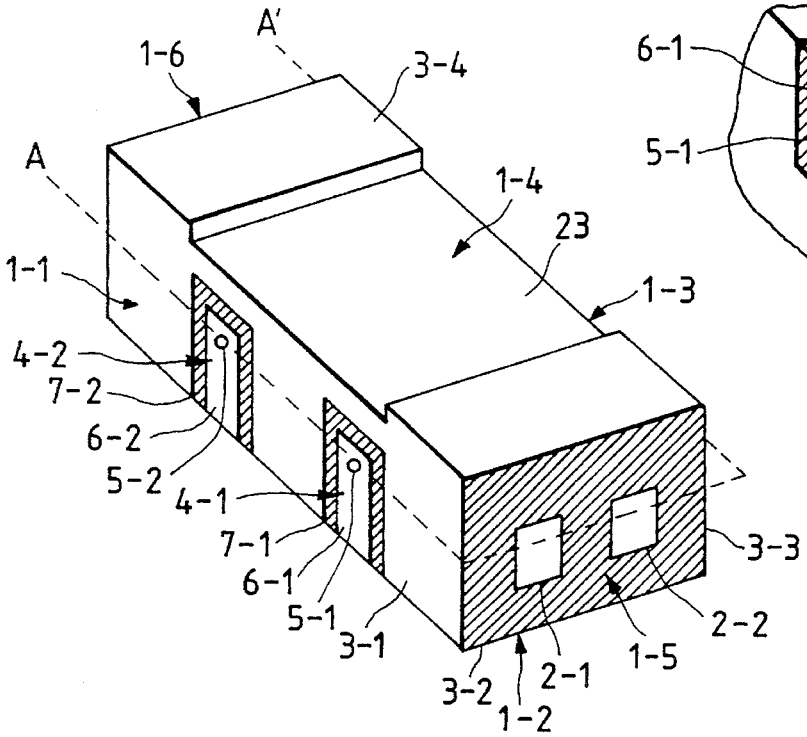
FIGS. 3(*a*), 3(*b*) and 3(*c*) are perspective, section and partial perspective views showing a balanced-type dielectric filter according to a second embodiment for the present invention.
Figure 3C:
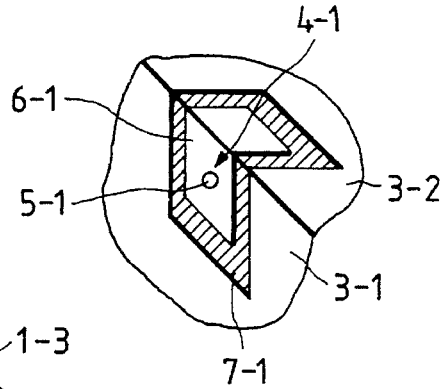
Figure 3B:
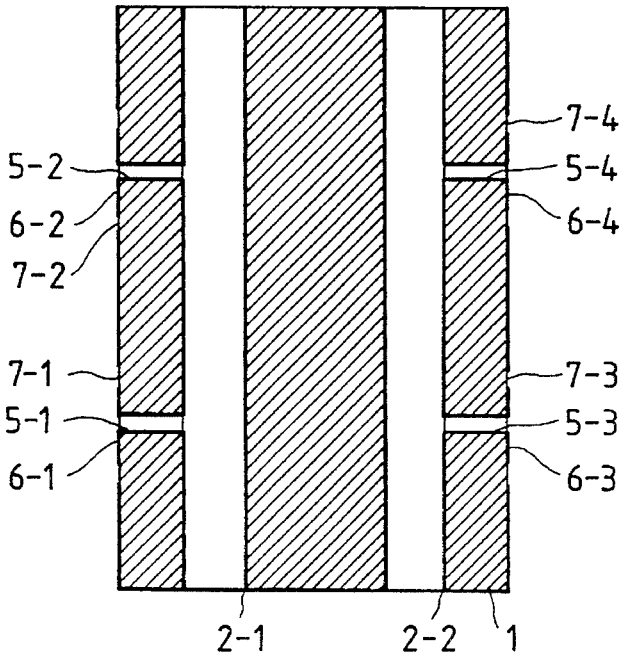

FIGS. 3(*a*), 3(*b*) and 3(*c*) are perspective, section and partial perspective views showing a balanced-type dielectric filter according to a second embodiment of the present invention, where FIG. 3(*a*) is a perspective view of the filter, FIG. 3(*b*) is a cross sectional view taken along the plane A—A' shown in FIG. 3(*a*), and FIG. 3(*c*) is a partial perspective view showing a terminal of the filter shown in the perspective view in FIG. 3(*a*).

As shown in FIG. 3(*a*), the filter includes a level difference portion 23—otherwise, the same reference numerals are given to same elements as those shown in FIG. 1(*a*) to FIG. 1(*c*).

The difference between the first embodiment and the second embodiment is that, in the first embodiment, the upper surface 1-4 of the dielectric block 1 is formed as a flat plane, whereas in the second embodiment, a level difference portion 23 formed in a central portion of the upper surface 1-4. In addition, in the first embodiment, a through hole 8 and a shielding conductor 9 are formed and disposed between the inner conductors 2-1 and 2-2, whereas the second embodiment omits the through hole 8 and the shielding conductor 9. Except for the above-mentioned points, there is no difference between the first and the second embodiments.

The operation of the balanced-type dielectric filter according to the second embodiment differs from that in the first embodiment only in the coupling between the inner conductors 2-1 and 2-2. Except for this point, the operation of the dielectric filter in the second embodiment is substantially the same as that of the balanced-type dielectric filter 10 of the first embodiment.

In the second embodiment, the distance between the inner conductors 2-1 and 2-2 and the upper conductor 3-4 is shorter near the central part of the inner conductors in the longitudinal direction by the level difference portion 23, so that part of the coupling energy between the inner conductors 2-1 and 2-2 is consumed by the coupling between the inner conductors 2-1 and 2-2 and the outer conductor 3-4. Therefore, the magnetic coupling between the inner conductors 2-1 and 2-2 is weakened by the consumed coupling energy, and the coupling by an electric field is generated between the inner conductors 2-1 and 2-2.

The balanced-type dielectric filter in the second embodiment can be incorporated into the high frequency circuit shown in FIG. 2, similar to the case of the balanced-type dielectric filter 10 in the first embodiment, so that the same effect can be obtained as that which can be obtained in the balanced-type dielectric filter 10 according to the first embodiment.

Figure 4A:
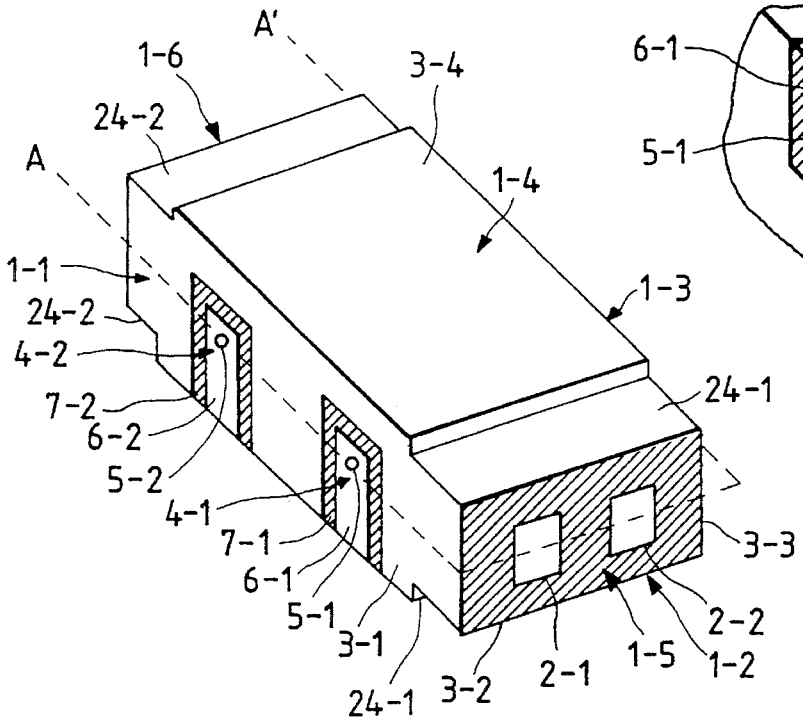
FIGS. 4(*a*), 4(*b*) and 4(*c*) are perspective, section and partial perspective views showing a balanced-type dielectric filter according to a third embodiment of the present invention.
Figure 4C:
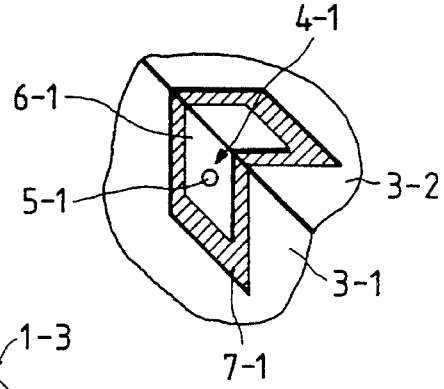
Figure 4B:
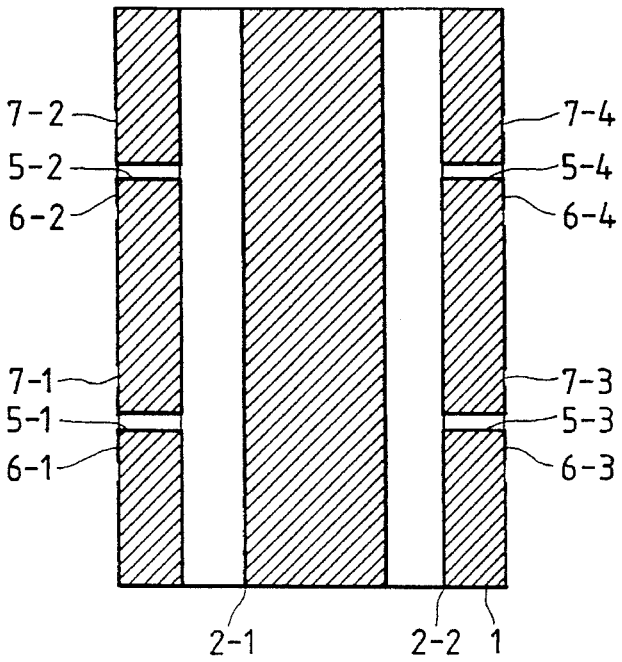

FIGS. 4(*a*), 4(*b*) and 4(*c*) are perspective, section and partial perspective views showing a third embodiment of a balanced-type dielectric filter according to the present invention, where FIG. 4(*a*) is a perspective view of the filter, FIG. 4(*b*) is a cross sectional view taken along the plane A—A' shown in FIG. 4(*a*), and FIG. 4(*c*) is a partial perspective view showing a portion of the back of the filter shown in the perspective view in FIG. 4(*a*).

As shown in FIG. 4(*a*), the filter includes first and second level difference portions 24-1 and 24-2. Except for this feature, the same reference numerals are given to the same elements as those shown in FIG. 1(*a*) to FIG. 1(*c*).

The only difference between the third embodiment and the second embodiment mentioned in the above is that the second embodiment comprises a level difference portion 23 formed in the central part in the longitudinal direction on the upper surface 1-4 of the dielectric block 1, whereas the third embodiment comprises two level difference portions 24-1 and 24-2 having the same shape formed at both ends of the upper surface 1-4 and the bottom surface 1-2 in the longitudinal direction of the dielectric block 1. Except for this feature, there is no difference between the third embodiment and the second embodiment.

The operation of a balanced-type dielectric filter according to the third embodiment differs from that according to the first embodiment only in the coupling means between the inner conductors 2-1 and 2-2. And except for this difference, the operation according to the third embodiment is substantially the same as that of the balanced-type dielectric filter 10 according to the first embodiment.

In the third embodiment, the distances between both end parts of the inner conductors 2-1 and 2-2 and the upper conductor 3-4 and lower conductor 3-2 are shortened, so that part of the coupling energy by an electric field between the two inner conductors 2-1 and 2-2 is consumed by the coupling between the upper and lower conductors 3-4 and 3-2 and the inner conductors 2-1 and 2-2, thereby weakening the coupling between the inner conductors 2-1 and 2-2 by the amount of the consumed coupling energy, and magnetic coupling is generated between the inner conductors 2-1 and 2-2.

It is possible to incorporate the balanced-type dielectric filter according to the third embodiment into the high frequency circuit shown in FIG. 2, in the same way as the balanced-type dielectric filter 10 according to the first embodiment, so that the same effect can be obtained in the balanced-type dielectric filter according to the third embodiment as that obtained in the dielectric filter 10 according to the first embodiment.

Figure 8A:
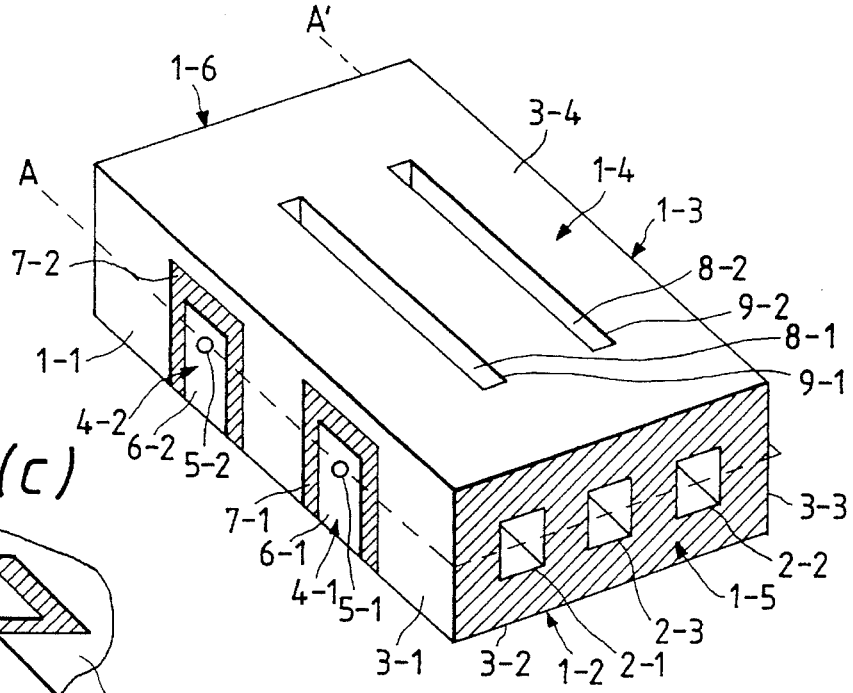
FIGS. 8(*a*), 8(*b*) and 8(*c*) are perspective, section and partial perspective views showing the constitution of a balanced-type dielectric filter according to a fourth embodiment of the present invention.
Figure 8C:
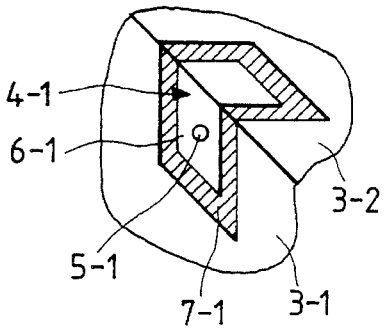
Figure 8B:
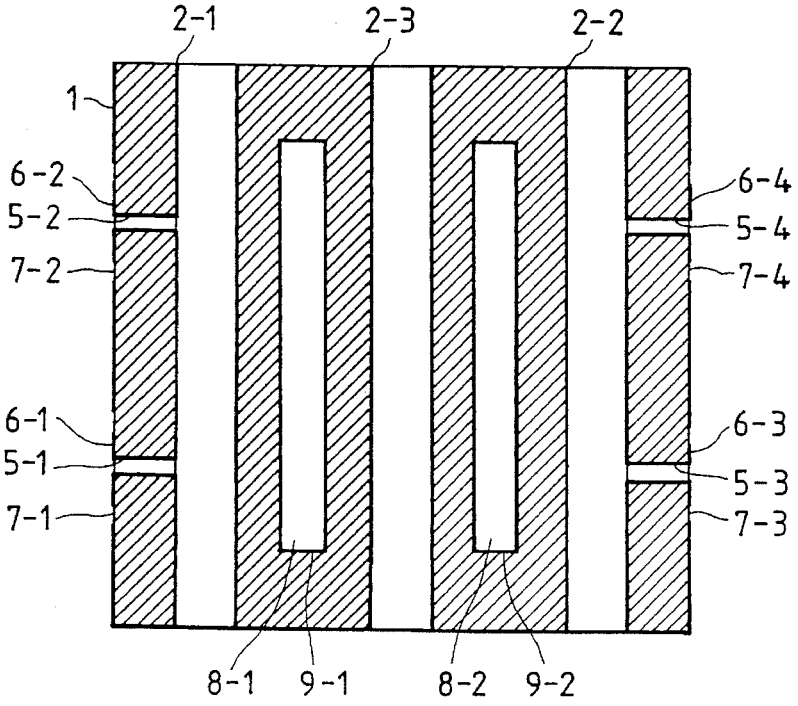

FIGS. 8(*a*), 8(*b*) and 8(*c*) are perspective, section and partial perspective views showing a fourth embodiment of the balanced-type dielectric filter according to the present invention, where FIG. 8(*a*) is a perspective view of the filter, FIG. 8(*b*) is a cross sectional view taken along the plane A—A' shown in FIG. 8(*a*), and FIG. 8(*c*) is a partial perspective view showing a terminal the filter shown in the perspective view in FIG. 8(*a*).

As shown in FIGS. 8(*a*) to 8(*c*), the balanced filter according to the third embodiment includes inner conductors 2-1 to 2-3, each having a length approximately equal to ½ of a selected wavelength and separated by through holes (slots) 8-1 and 8-2, wherein shielding conductors 9-1 and 9-2 are formed on the inside surfaces of the through holes 8-1 and 8-2. Other elements and structures which are common with the first and second embodiments are identified with common reference numerals.

The fourth embodiment differs from the first embodiment in the number of inner conductors 2-1 to 2-3, and in the number of shielding conductors 9-1 and 9-2. In the fourth embodiment there are three inner conductors and two shielding conductors. The inner conductors 2-1 and 2-2 have the same constitution as that of the first embodiment, and both shielding conductors 9-1 and 9-2 have the same constitution as that of the shielding conductor 9 in the first embodiment. The inner conductor 2-3 differs from the other inner conductors 2-1 and 2-2 in that it is not connected to the connecting conductors 5-1 to 5-4. The three inner conductors 2-1 to 2-3 are disposed in parallel with each other. The two shielding conductors 9-1 and 9-2 are disposed between the inner conductors 2-1 and 2-3 and between the inner conductors 2-3 and 2-2 which generates coupling between adjacent conductors.

The operation of the balanced-type dielectric filter in the fourth embodiment is basically the same as that of the balanced-type dielectric filter in the first embodiment, so that further explanation will be omitted.

In the above-mentioned respective embodiments, explanations are given about the examples in which the outer conductors 3-1 to 3-4 are formed and disposed on the four outside surfaces 1-1 to 1-4 of the dielectric block 1. However, the present invention is not limited to such a construction, and the outer conductors can be formed and disposed only on two of the four outside surfaces.

In the above-mentioned respective embodiments, examples are provided in which the outer conductors are not formed and disposed on the two outside surfaces 1-5 and 1-6 of the dielectric block 1; however, the present invention is not limited to such a constitution, and the outer conductors can be formed and disposed on the outside surfaces 1-5 and 1-6, respectively. In this case, these outer conductors would have to be insulated from the inner conductors 2-1 and 2-2.

What is claimed is:

1. A balanced-type dielectric filter comprising:

a dielectric block having an approximately rectangular parallelepiped shape, the dielectric block having an upper surface, a lower surface, a first side surface, a second side surface, a first end surface and a second end surface;

first and second inner conductors formed within the dielectric block, the first and second inner conductors being disposed in parallel and extending from the first end surface to the second end surface;

first and second outer conductors disposed on two or more of the upper, lower, first side and second side surfaces of said dielectric block;

first, second, third and fourth connecting conductors formed in the dielectric block, the first and second connecting conductors extending from the first inner conductor to the first side surface, and the third and fourth connecting conductors extending from the second inner conductor to the second side surface; and first, second, third and fourth terminals formed on the first and second side surfaces of the dielectric block, the first and second terminals being respectively connected to the first and second connecting conductors, and the third and fourth terminals being respectively connected to the third and fourth connecting conductors, said first, second, third and fourth connecting conductors being insulated from the first and second outer conductors.

2. The balanced-type dielectric filter according to claim 1, wherein said dielectric block defines a slot extending from the upper surface to the lower surface of the dielectric block, the slot being located between the first and second inner conductors, and the dielectric filter includes a shielding conductor formed on an inner surface of the slot and electrically connected to the first and second outer conductors.

3. The balanced type dielectric filter according to claim 1, wherein a first distance between portions of the upper and lower surfaces located adjacent the first and second end surfaces differs from a second distance between portions of the upper and lower surfaces located midway between the first and second end surfaces.

4. A high frequency circuit comprising:

a first stage including first and second output terminals, the first stage generating a high frequency balanced-type output signal;

a balanced-type dielectric filter including first and second terminals connected to receive the high frequency balanced-type output signal from the first and second output terminals, and third and fourth terminals for generating a filtered high-frequency balanced-type signal; and a second stage including first and second input terminals connected to receive the filtered high-frequency balanced-type signal from the third and fourth terminals of the balanced-type dielectric filter;

wherein the balanced-type dielectric filter includes:

a dielectric block having an approximately rectangular parallelepiped shape, the dielectric block having an upper surface, a lower surface, a first side surface, a second side surface, a first end surface and a second end surface;

first and second inner conductors formed within the dielectric block, the first and second inner conductors being disposed in parallel and extending from the first end surface to the second end surface;

first and second outer conductors disposed on two or more of the upper, lower, first side and second side surfaces of said dielectric block; and first, second, third and fourth connecting conductors formed in the dielectric block, the first and second connecting conductors extending from the first inner conductor to the first side surface, and the third and fourth connecting conductors extending from the second inner conductor to the second side surface; and wherein the first, second, third and fourth terminals are formed on the first and second side surfaces of the dielectric block, the first and second terminals being respectively connected to the first and second connecting conductors, and the third and fourth terminals being respectively connected to the third and fourth connecting conductors, the first, second, third and fourth connecting conductors being insulated from the first and second outer conductors.

5. The high frequency circuit according to claim 4, wherein said dielectric block defines a slot extending from the upper surface to the lower surface of the dielectric block, the slot being located between the first and second inner conductors, and the dielectric filter includes a shielding conductor formed on an inner surface of the slot and electrically connected to the first and second outer conductors.

6. The high frequency circuit according to claim 4, wherein a first distance between portions of the upper and lower surfaces located adjacent the first and second end surfaces differs from a second distance between portions of the upper and lower surfaces located midway between the first and second end surfaces.

* * * * *